US005082677A

United States Patent [19]

Bear

[11] Patent Number: 5,082,677

[45] Date of Patent: Jan. 21, 1992

[54] PACKAGING MEANS AND METHOD FOR SHIPPING PASTRIES

[76] Inventor: Avi Bear, 6390 May St., Cincinnati, Ohio 45243

[21] Appl. No.: 554,390

[22] Filed: Jul. 19, 1990

[51] Int. Cl.[5] ..... A21D 15/00

[52] U.S. Cl. ..... 426/124; 206/551; 426/87; 426/128; 426/383

[58] Field of Search ..... 426/122, 123, 124, 128, 426/104, 87, 383; 206/551; 928/7

[56] References Cited

U.S. PATENT DOCUMENTS

| | | | |
|---|---|---|---|
| 519,005 | 5/1894 | Reeves, Jr. . | |
| 1,554,077 | 9/1925 | Fay . | |
| 1,710,164 | 4/1929 | Hefler . | |
| 1,890,044 | 12/1932 | Policastro et al. | 426/87 |
| 1,927,435 | 9/1933 | Derst . | |
| 2,339,584 | 1/1944 | Rice | 426/396 |
| 2,430,566 | 11/1947 | Harriss | 426/87 |
| 2,525,337 | 10/1950 | Brooks et al. . | |
| 2,606,651 | 8/1952 | Bencich . | |
| 3,677,168 | 7/1972 | Bell | 99/234 |
| 3,771,713 | 11/1973 | Davidson | 206/551 |
| 4,329,159 | 11/1982 | Pollard | 206/551 |
| 4,877,609 | 10/1989 | Beck et al. | 426/115 |

FOREIGN PATENT DOCUMENTS

| | | | |
|---|---|---|---|
| 562966 | 9/1958 | Canada | 426/124 |

*Primary Examiner*—Donald E. Czaja
*Assistant Examiner*—Anthony J. Weier
*Attorney, Agent, or Firm*—Wood, Herron & Evans

[57] ABSTRACT

A pastry is cut into slices and folded dividers are pressed down into the cuts between the slices. Upstanding supports are inserted into the dividers, resting on the divider folds at the bottom of the cuts and extending above the pastry. The supports extend to the top of a container and, if the container is turned upside down, hold the pastry against damage.

21 Claims, 1 Drawing Sheet

PACKAGING MEANS AND METHOD FOR SHIPPING PASTRIES

FIELD OF THE INVENTION

This invention relates to a packaging means and method by which pastries can be shipped without damage.

BACKGROUND

Those in the baking industry know that it is nearly impossible to ship pastries (especially sliced pastries) without their becoming damaged in transit. Movement jostles the pastry against the sides of the container and, if the container should be inverted, the pastry is mashed, decorations are broken and icing is cracked.

Various devices have been proposed for containing and/or shipping pastry, as shown in Fay U.S. Pat. No. 1,554,077; Hefler U.S. Pat. No. 1,710,164; Derst U.S. Pat. No. 1,927,435; Brooks U.S. Pat. No. 2,525,337; Bencich U.S. Pat. No. 2,606,651; Bell U.S. Pat. No. 3,677,168, and Pollard U.S. Pat. No. 4,359,159. Those devices are relatively complicated to use; they are also expensive (especially for one-time use), and their weight increases the cost of shipping. Moreover, they do not effectively protect the pastry if the container is turned over.

SUMMARY OF THE INVENTION

It has been the object of this invention to provide a simple structure for shipping pastries which is easy to use, lightweight, inexpensive, and which affords good protection even to delicately decorated and iced pastries, even if it is inverted in shipment.

The invention is useful with cakes (including cheese cakes and truffle cakes), tarts, pies, and other baked goods which are pre-sliced. (As used herein the term "pastry" means and includes each of the foregoing, decorated and undecorated, iced and uniced.)

The pastry is sliced before it is packaged. If it is circular, the slices may be wedge-shaped; if it is rectangular the slices may be square. Whatever the shape of the slices, folded sheet-like "dividers" are pressed down into the cuts between adjacent slices. These dividers may be of tough paper such as parchment paper, and are folded approximately in half for pressing into place. The fold line is pushed into the cut down to the base on which the pastry sits. The opposite leaves or sides of each divider facially engage the cut faces of the pastry slices on each side. Such dividers are commonly placed in frozen pre-sliced pastries as an incident to the slicing itself, for the purpose of isolating the slicing blade from the pastry. They prevent the slices from readhering before serving (which cut slices tend to do, especially if frozen), and facilitate separating the slices from one another for serving. Presliced pastries are conventionally sold with such dividers inserted.

Following insertion of the dividers between the slices, flat planar generally rectangular supports or spacers are then inserted into the upwardly opening dividers, between at least some of the slices. The supports may be in the form of cardboard panels having a height greater than that of the pastry and substantially equal to the inside height of the container in which the pastry is to be placed (less the thickness of any tray or base on which the pastry rests), so that when in the container the support will substantially engage the underside of the top or lid of the box. Preferably, but not necessarily, each support has a vertical flap which projects beyond the end of the slices and which can be folded to lie close to the side of the pastry.

Dividers are usually inserted in all the cuts; supports need not be inserted into every divider. Usually a support every two or three slices is sufficient, for example in a circular 10" cheese cake cut into 16 slices, 16 dividers are used but only about 6–8 supports may be used.

When the pastry is placed in the container and the lid closed, the upper ends of the supports engage the underside of the lid; friction or adhesion of the cut slices to the dividers in turn immobilizes the slices. Surprisingly, thus packaged the pastry is effectively protected against damage even if the container should be inverted. The supports hold the slices spaced away from the box top, and the support end flaps protect the pastry from shifting laterally. When folded the flaps form "Ls" which stiffen the supports against bending and also tend to hold the pastry centered in the container spaced from the container wall.

DESCRIPTION OF THE DRAWINGS

The invention can best be described by reference to the accompanying drawings, in which.

DETAILED DESCRIPTION

Figure 1:
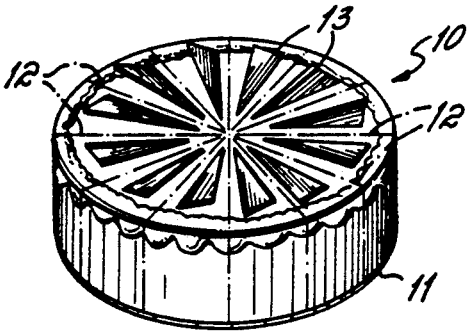
FIG. 1 is a perspective view of a pastry prior to cutting.

The present packaging structure and method are useful for a wide variety of pastries; for purposes of explanation, the drawing shows a glazed and decorated cheese cake 10 which is especially delicate and susceptible to injury in shipment. The pastry can be any of the standard sizes and shapes, including but not limited to circular pastries (usually 8" to 16" in diameter) and rectangular pastries (for example, 12" to 18" on the sides). The pastry 10 shown in the drawing is round, for example about 8" in diameter and 2" high, with decorations 13 which extend up to about 1½" above the top. That pastry is to be sliced into 12 wedge-shaped slices or sections 14 (each about 30° angular width), the locations of the cuts to be made being indicated by dotted lines 12. (Larger pastries may be cut into more slices). In general slices may be of the usual sizes. The pastry preferably sits on a conventional cardboard "circle" or base 11 of substantially the same diameter as it is.

Although the slices 14 can be cut manually, cutting is preferably done by a mechanical cake and pie slicer, for example of the type made by Food Tools, Inc., 123 Santa Barbara Street, Santa Barbara, Calif. 93101. Such machines, which are commercially available, make cuts across the diameter of the pastry with a vertically reciprocable guillotine type blade. The machine automatically indexes the pastry 10 rotationally to make a desired number of cuts. Preferably the pastry is cut while it is frozen or at least chilled.

Figure 2:
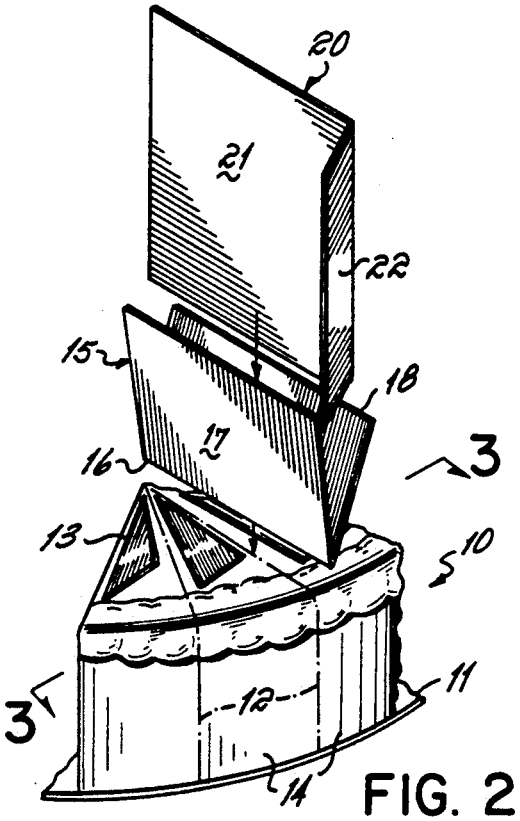
FIG. 2 is an enlarged perspective of a portion of the pastry of FIG. 1, showing diagrammatically the insertion of a divider and support.

As an incident to use of the slicing machine, a foldable paper divider 15 is positioned in the downward path of the cutting blade (indicated by the arrows in FIG. 2). The downward cutting movement of the blade into the pastry folds and presses the divider into the cut as the cut is made. For a cake 8" in diameter and 2" high, divider papers of parchment paper (which are available commercially) may be about 4"×4¼", so that when folded in half along a fold line 16 and inserted longitudinally, the leaves 17, 18 on each side of fold 16 will approximate and facially engage the area of the cut surface of each slice.

Figure 3:
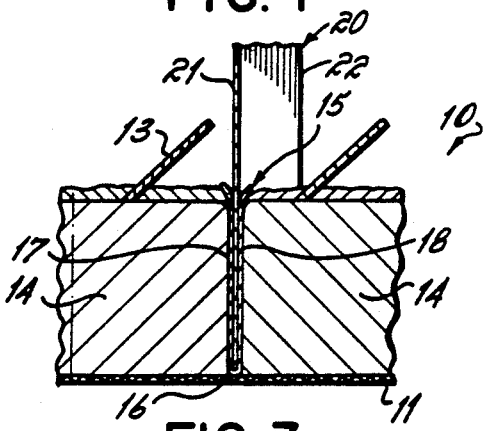
FIG. 3 is a vertical section taken on line 3—3 of FIG. 2, with a divider and support inserted.

Each divider 15 is folded and pressed by the blade to the bottom of the cut, substantially to base 11 as shown in FIG. 3. Separate dividers are used on each side of the intersection of the cuts at the center, rather than a single divider extending across the intersection. For purposes of this invention, preferably each divider should project just slightly above the top of the cake, e.g., by ⅛". This facilitates the subsequent insertion of the supports.

After the dividers have been inserted supports 20 are inserted between the leaves of some or all of the dividers 15. Each support 20 is a generally rectangular panel which may be made of cardboard, thin wood or plastic or the like, and has a face 21 and, preferably, a vertical end flap 22. The face should have substantially the same width as the divider (e.g., the radius of cake 10, about 4" in the example described). Flap 22 lies outside the cake and may be about 1" wide. In use the flap 22 is folded vertically at angle to the face, so that it extends nearly tangential to the side of the cake. The flap strengthens the divider and spaces the side of the cake from the side of the container. The support 20 is preferably slipped down into the folded divider 15 from above; it need not touch pastry 10 at all except possibly along a vertical edge if it is not centered in the divider. Since the inserted panel of the support is flat, it does not deform or enlarge the cut.

Conventionally a pastry is put in a box just slightly taller than it is; the top of the cake may nearly touch the lid and damage is practically inevitable if the box is inverted. In this invention the supports 20 space the pastry vertically from the lid. The support 20 should be taller than the pastry 10 and decorations 13. For a cheese cake 2" high with 1½" of decoration 13, a 5" deep box 30 may be used, and the supports 20 should be as tall as the inside height of the box less the thickness of the base 11. Thus, for a box having a 5" inside height and a base which is ⅛" thick, the height of the support 20 should be about 4⅞". The supports should be stiff enough to support the weight of the pastry if the box is inverted. As already noted, it is easier to insert the supports 20 between the leaves 17 and 18 of the dividers 15 if the leaves project above the top of the pastry.

Supports 20 can be placed in every divider 15 (i.e., between every pair of adjacent slices), but I have found that it is not necessary to use so many. Supports can be spaced every 2 or 3 slices, depending upon the nature and size of the pastry and the number of cuts. In the pastry shown in the drawing, 5 supports are used in the 12 cuts. Larger slices require relatively more supports.

Figure 4:
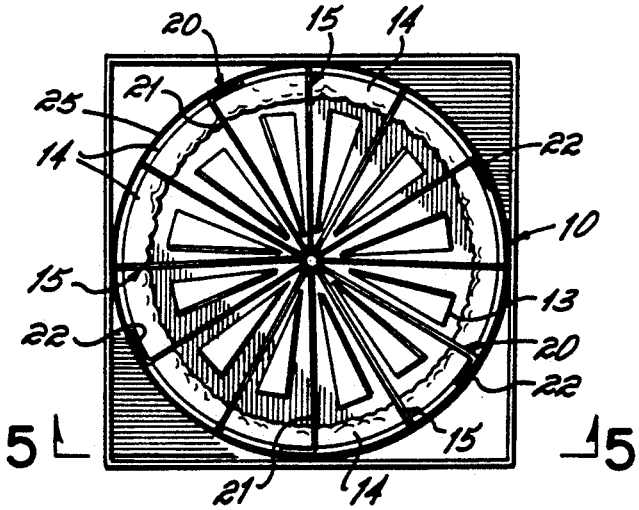
FIG. 4 is a top plan view of the pastry in a box, with dividers and supports in place.
Figure 5:
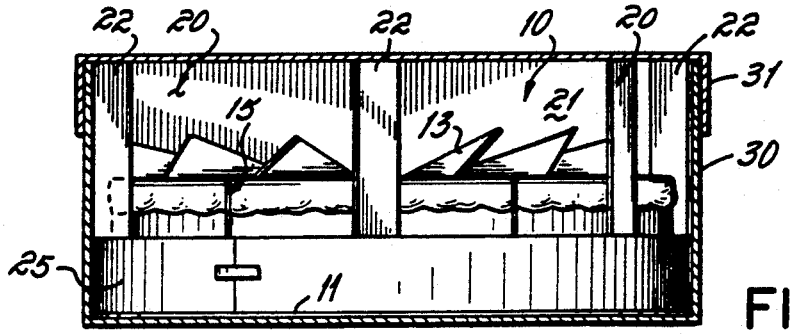
FIG. 5 is a vertical section taken on line 5—5 of FIG. 4.

After the supports have been inserted, their end flaps 22 are folded (see FIGS. 3 and 4), an elongated strip of paper 25 is desirably fastened circumferentially around the folded flaps 22, and its ends are taped together to form a circular loop which holds the flaps 22 in for insertion into box 30 or other container. The pastry, with the flaps folded, should fit closely inside the box so that it cannot move laterally. It can be seen that supports 20 substantially engage the underside of the lid 31 of the box (FIG. 5).

Preferably the pastry is shipped frozen (as with dry ice in the conventional manner), or refrigerated. Chilling hardens the fat content of the pastry and appears to improve the friction or adherence of the slices to the dividers. If the container should be inverted, the supports hold the dividers in place (the supports bear upon the dividers at the folds); and friction or adherence between the slices 14 and the dividers holds the slices in place. Tests have demonstrated that a box containing a frozen pastry so packaged can be inverted without damage to the pastry. At room temperature, some pastries such as fruit pies may tend to run if inverted, but if refrigerated or frozen they will adhere to the dividers and be supported by the supports.

The supports, especially the top parts which project above the cake, can be used for advertising and provide clearance for the decorations 13 on top of the cake. Moreover, the supports stiffen the box itself so that lighter material can be used for the box. It is thus possible to stack boxes, even of light construction which ordinarily could not be stacked without crushing the pastry in them.

While the invention has been described in relation to packaging a whole round cake in a square box, it should be noted that the invention can be used with square or rectangular pastries as well as with portions of pastries (for example, half a round cheese cake), so long as the container is appropriately sized. Use of the loop 25 to surround the end flaps 22 also improves the effectiveness of the invention.

Having described the invention, what is claimed is:

1. A decorated whole pastry packaged in a container, said pastry having a series of cuts forming slices, dividers inserted downwardly into the cuts between slices, each divider comprising a slip of flexible sheet material having a fold between opposite leaves, the fold being at the bottom of the respective cut, said leaves engaging the cut faces of adjacent slices, supports inserted in dividers in at least some of the cuts, each support comprising a flat, stiff element between the leaves of the respective divider, the support resting on the fold of the divider, said supports being higher than said pastry and projecting above the top thereof, each said support having an upright end flap which is folded about a vertical axis outside of said pastry and spaced from said end flaps of adjacent supports, each said end flap projecting from said divider approximately parallel to the side of said pastry, said pastry being in a container having a bottom, a side wall, and a top, said supports substantially engaging the underside of the top of said container, friction between the slices and said dividers resisting movement of the slices relative to said dividers, said dividers and supports holding the pastry upwardly against damage in said container if said container is inverted.

2. A packaged pastry in accordance with claim 1 further including a strip of paper around the circumference of said pastry, said strip engaging and confining said flaps.

3. A packaged pastry in accordance with claim 1 wherein said pastry is circular and said slices are wedge-shaped.

4. A packaged pastry in accordance with claim 3 wherein said dividers extend from substantially the center of the cake to the side thereof.

5. A packaged pastry in accordance with claim 1 wherein said supports contact only the respective dividers and do not contact the slices where such have been cut and divided.

6. A packaged pastry in accordance with claim 1 wherein said dividers extend above the top of the pastry.

7. A packaged pastry in accordance with claim 1 wherein said supports are inserted into dividers from above.

8. A packaged pastry in accordance with claim 1 wherein said dividers are parchment paper.

9. A packaged pastry in accordance with claim 1 wherein said supports are cardboard.

10. A packaged pastry in accordance with claim 1 wherein a support is inserted in approximately every other divider.

11. A packaged pastry in accordance with claim 1 wherein said pastry is circular and said container is square.

12. A packaged pastry in accordance with claim 1 wherein said pastry is refrigerated.

13. A packaged pastry in accordance with claim 12 wherein said pastry is frozen.

14. A method of packaging a decorated whole pastry comprising, forming cuts in the pastry, forming a central fold in a divider between opposite leaves thereof and inserting dividers so folded downwardly into said cuts, the folds being pressed to the bottom of the cuts and said leaves engaging opposite sides of the cuts, inserting upstanding supports into at least some of the dividers, each support resting on the fold of the respective divider and projecting above the top of the pastry, said supports also projecting laterally beyond the side of the pastry, folding the projecting ends of the supports about vertical axes outside of said pastry to rigidify the supports, inserting the pastry in a container and closing a top of said container, said supports substantially engaging the underside of said top, friction between the pastry and the dividers resisting movement of the pastry relative to the dividers, the supports and dividers holding the whole pastry against damage in said container if the container is inverted.

15. The method of claim 14 comprising the further step of placing a circular loop around the folded projecting ends of said supports to hold said ends close to the side of said pastry.

16. The method of claim 14 wherein supports are placed in some, but less than all, of the dividers.

17. The method of claim 14 wherein the dividers are inserted into the outs by a slicing blade while making the cuts.

18. The method of claim 14 wherein the dividers extend above the top of the cake and the supports are inserted between the leaves of the respective dividers from the top thereof.

19. The method of claim 14 wherein said cuts form slices of the pastry.

20. The method of claim 14 wherein the packaged pastry is refrigerated.

21. The method of claim 20 wherein the packaged pastry is frozen.

* * * * *